US007661235B2

(12) United States Patent
Stoecker

(10) Patent No.: US 7,661,235 B2
(45) Date of Patent: Feb. 16, 2010

(54) MODULAR PANEL SYSTEM AND METHOD

(75) Inventor: Gary L. Stoecker, Bloomington, MN (US)

(73) Assignee: Transamerican Strukturoc, Inc., Eagan, MN (US)

( * ) Notice: Subject to any disclaimer, the term of this patent is extended or adjusted under 35 U.S.C. 154(b) by 0 days.

(21) Appl. No.: 11/638,197

(22) Filed: Dec. 13, 2006

(65) Prior Publication Data

US 2008/0141607 A1 Jun. 19, 2008

(51) Int. Cl.
*E04B 2/30* (2006.01)
*E04D 1/34* (2006.01)

(52) U.S. Cl. ..... 52/478; 52/489.1; 52/539; 52/546; 52/520; 52/592.1

(58) Field of Classification Search ..... 52/489.1, 52/489.2, 539, 546, 520, 478, 529, 531, 545, 52/592.1; 403/329, 397
See application file for complete search history.

(56) References Cited

U.S. PATENT DOCUMENTS

| | | | | | |
|---|---|---|---|---|---|
| 422,571 | A | * | 3/1890 | Cooper | 52/529 |
| 892,248 | A | * | 6/1908 | Garvin | 52/520 |
| 3,142,937 | A | * | 8/1964 | Ess | 52/520 |
| 3,187,389 | A | * | 6/1965 | Anderson | 52/489.1 |
| 3,225,504 | A | * | 12/1965 | Gregoire | 52/509 |
| 3,512,222 | A | * | 5/1970 | Tinnerman | 24/561 |
| 3,824,756 | A | * | 7/1974 | Kessler | 52/546 |
| 4,037,377 | A | * | 7/1977 | Howell et al. | 52/309.9 |
| 4,091,588 | A | * | 5/1978 | Heirich | 52/478 |
| 4,104,840 | A | | 8/1978 | Heintz et al. | |
| 4,123,885 | A | * | 11/1978 | Scott | 52/489.1 |
| 4,184,301 | A | | 1/1980 | Anderson et al. | |
| 4,283,897 | A | * | 8/1981 | Thompson | 52/506.1 |
| 4,295,316 | A | * | 10/1981 | Carlson | 52/588.1 |
| 4,316,351 | A | * | 2/1982 | Ting | 52/309.9 |
| 4,463,533 | A | * | 8/1984 | Mullet | 52/394 |
| 4,522,007 | A | | 6/1985 | Oehlert | |
| 4,561,233 | A | | 12/1985 | Harter et al. | |
| 4,570,404 | A | * | 2/1986 | Knudson | 52/520 |
| 4,700,520 | A | | 10/1987 | Ting | |
| 4,936,078 | A | | 6/1990 | Porter | |
| 5,012,623 | A | | 5/1991 | Taylor | |

(Continued)

OTHER PUBLICATIONS

International Search Report, dated Nov. 21, 2008.

*Primary Examiner*—Robert J Canfield
*Assistant Examiner*—Brent W Herring
(74) *Attorney, Agent, or Firm*—Patterson, Thuente, Skaar & Christensen, P.A.

(57) ABSTRACT

Methods and systems are provided for an exterior covering capable of withstanding extreme wind loads. In one embodiment, a wind resistant exterior covering includes a first panel fastened to a substrate and a second panel fastened to the substrate. The second panel engages the first panel, and a clip fastened to the substrate is adapted and located to laterally restrain movement of the second panel with respect to the first panel. In another embodiment, a method of engaging panels of a modular exterior covering system includes coupling a protruding portion of a first panel with a respective receiving portion of a second panel. The coupling is such that the first panel is laterally restrained by the second panel and a clip, and the first panel is outwardly restrained by the receiving portion of the second panel.

16 Claims, 11 Drawing Sheets

U.S. PATENT DOCUMENTS 5,134,825 A * 8/1992 Berridge ..... 52/520
5,140,793 A * 8/1992 Knudson ..... 52/520
5,277,011 A * 1/1994 Serrano Martin ..... 52/588.1
5,355,649 A * 10/1994 Berridge ..... 52/520
5,425,210 A * 6/1995 Zafir ..... 52/404.4
5,519,974 A 5/1996 Greenberg
5,653,550 A * 8/1997 Mutz et al. ..... 403/329
5,758,467 A * 6/1998 Snear et al. ..... 52/592.1
5,953,878 A * 9/1999 Johnson ..... 52/582.2
6,056,359 A * 5/2000 Clark ..... 297/237
6,332,733 B1 * 12/2001 Hamberger et al. ..... 403/329
6,516,579 B1 2/2003 Pervan
6,637,163 B2 * 10/2003 Thibault et al. ..... 52/177
6,701,678 B1 * 3/2004 Skov et al. ..... 52/79.9
6,997,635 B2 * 2/2006 Liu et al. ..... 403/329
7,007,433 B2 3/2006 Boyer
7,010,894 B1 * 3/2006 Cappelle ..... 52/480
7,571,571 B1 * 8/2009 Mershon ..... 52/36.5
2003/0121226 A1 * 7/2003 Bolduc ..... 52/391
2006/0214545 A1 9/2006 Wells et al.
2007/0039275 A1 * 2/2007 Boyer ..... 52/592.1

* cited by examiner

Fig. 4
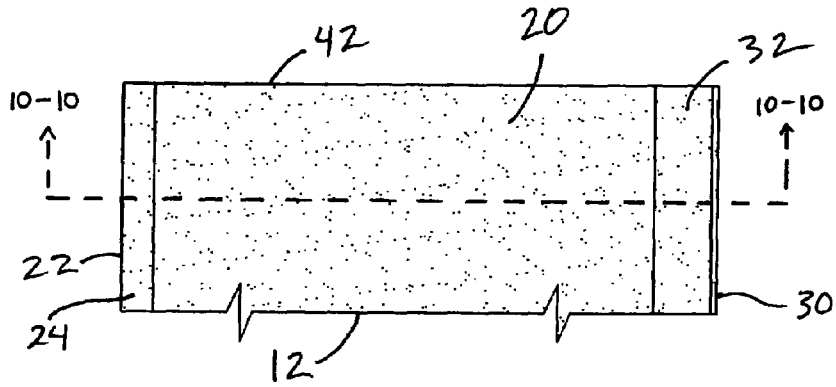
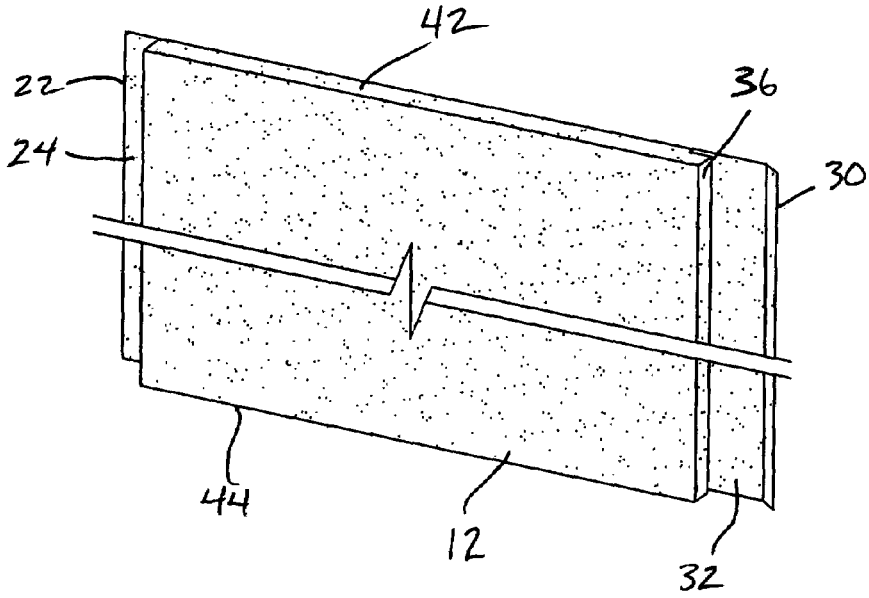
Fig. 3

Fig. 9
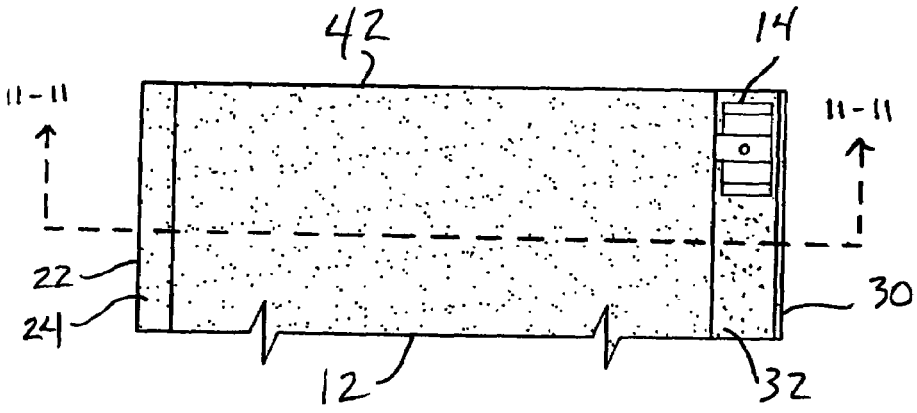
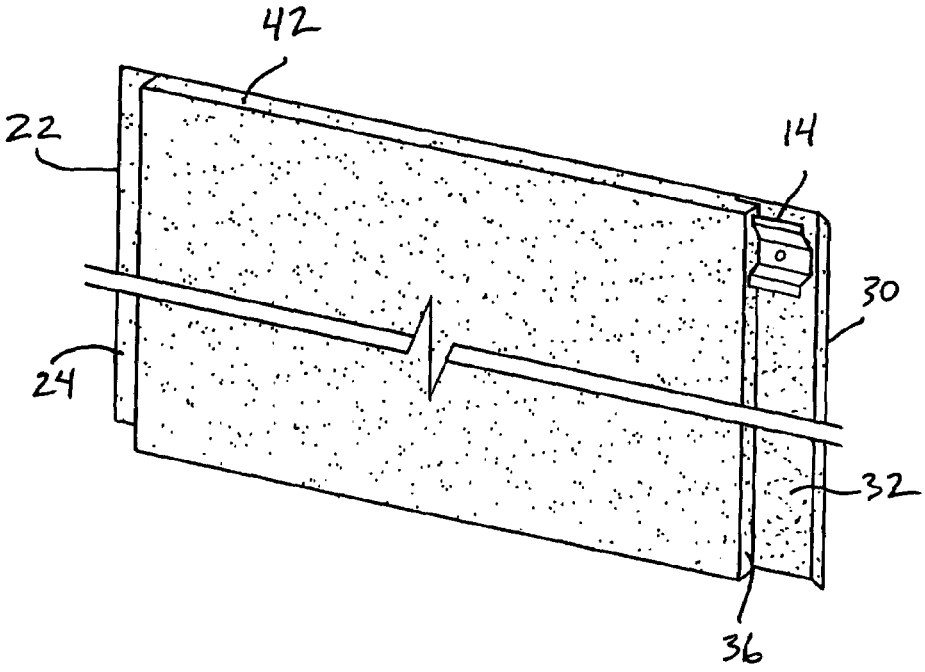
Fig. 8

MODULAR PANEL SYSTEM AND METHOD

FIELD OF THE INVENTION

The present invention relates generally to modular building panels. More specifically, the present invention relates to a wall panel system adapted to withstand extreme weather conditions and a method of installing the same.

BACKGROUND OF THE INVENTION

Modular panels arranged in an abutting relationship to form the walls and/or roof of a building have been used for years as exterior coverings in the construction of structures, typically in commercial structures. Panels are either vertically oriented and arranged side-by-side, or horizontally oriented and arranged one on top of another. Preferably, panels are interconnecting with one another, so that each panel has a male side and a female side. The male side of one panel engages the female side of an adjoining panel, joining the panels. The profile of the male and female sides may be such that a friction fit is created between the two panels, strengthening the joint.

Examples of prior art construction panels and methods of joining the panels are disclosed in U.S. Pat. No. 4,522,007 to Oehlert, U.S. Pat. No. 4,561,233 to Harter et al., U.S. Pat. No. 4,700,520 to Ting, U.S. Pat. No. 4,936,078 to Porter, and U.S. Pat. No. 5,012,623 to Taylor, the disclosures of which are hereby incorporated by reference in their entirety. Conventional panels and panel systems are overly complex and lack the ability to stay in place in extreme wind and other weather conditions. Therefore, there is a need to provide for a relatively simple system that can perform in extreme weather conditions.

SUMMARY OF THE INVENTION

In one exemplary embodiment, the present invention comprises a wind resistant exterior covering comprising a first panel fastened to a substrate, a second panel fastened to a substrate and engaging the first panel, and a clip fastened to the substrate adapted and located to laterally restrain movement of the second panel with respect to the first panel.

In another exemplary embodiment, the present invention comprises a method for securing a exterior covering to a building so as to resist wind loads exceeding 200 miles per hour, the method comprising fastening a first panel to a substrate, fastening a clip to a substrate and the first panel, inserting a protruding portion of a second panel into a respective receiving portion of the first panel, the protruding portion being outwardly restrained by the receiving portion, and moving the second panel to an engaged position where the second panel is laterally restrained by the first panel and the clip.

In another exemplary embodiment, the present invention comprises a method of engaging panels of a modular exterior covering system, the method comprising coupling a protruding portion of a first panel with a respective receiving portion of a second panel so that the first panel is laterally restrained by the second panel and a clip and is outwardly restrained by the receiving portion of the second panel.

BRIEF DESCRIPTION OF THE DRAWINGS

The present invention can be more completely understood and appreciated by referring to the following more detailed description of the presently preferred exemplary embodiments of the invention in conjunction with the accompanying drawings, of which:

FIG. 3 is a perspective view of a panel according to an embodiment of the present invention.

FIG. 4 is a front view of a panel according to an embodiment of the present invention.

FIG. 8 is a perspective view of a retaining clip installed on a panel according to an embodiment of the present invention.

FIG. 9 is a front view of a retaining clip installed on a panel according to an embodiment of the present invention.

DETAILED DESCRIPTION OF THE DRAWINGS

Figures 1, 1A:
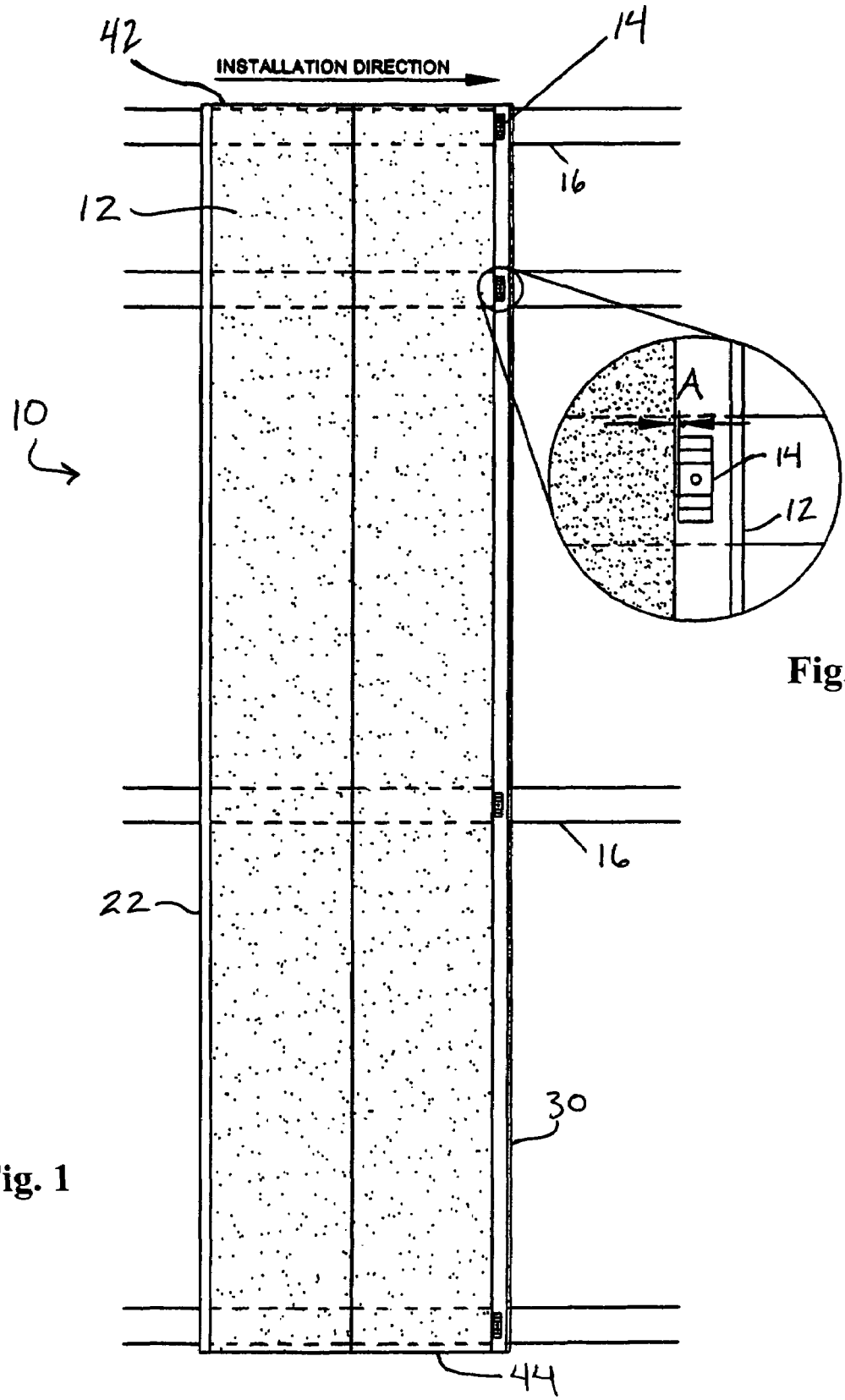
FIG. 1 is a front view of a panel system according to an embodiment of the present invention.
FIG. 1A is a close-up detail view of a portion of FIG. 1.
Figures 2, 2A:
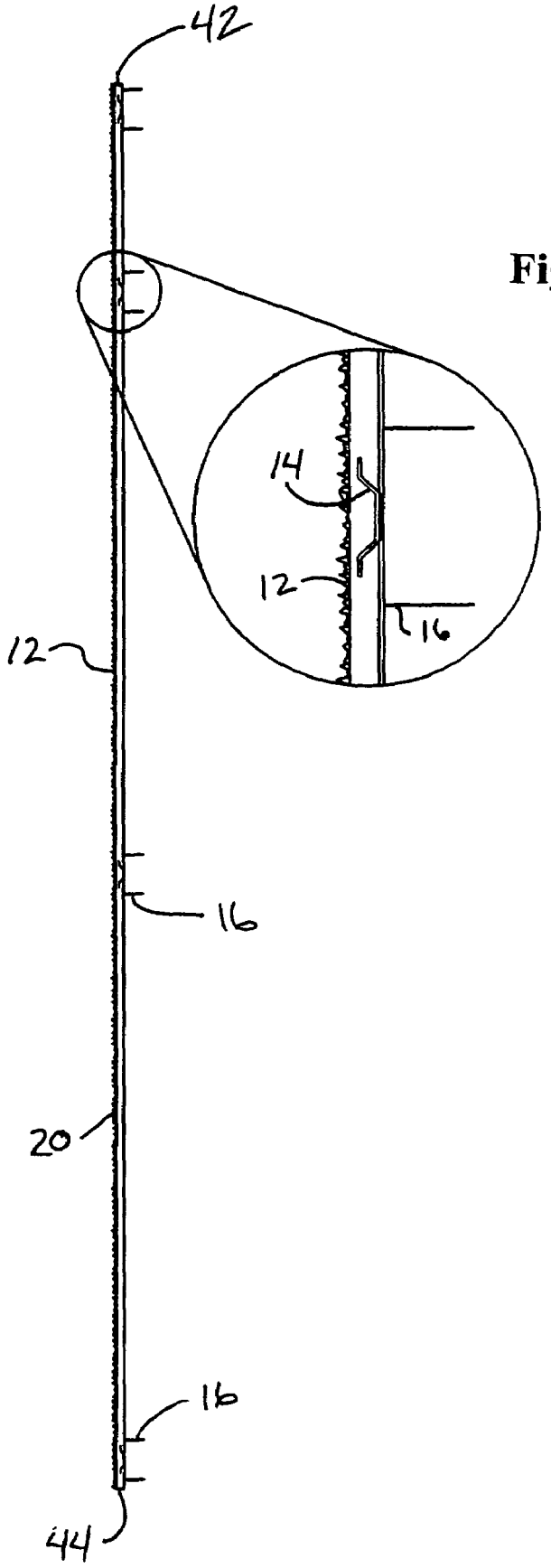
FIG. 2 is a side view of a panel system according to an embodiment of the present invention.
FIG. 2A is a close-up of a portion of FIG. 2.

In the following detailed description of the present invention, numerous specific details are set forth in order to provide a thorough understanding of the present invention. However, one skilled in the art will recognize that the present invention may be practiced without these specific details. In other instances, well-known methods, procedures, and components have not been described in detail so as to not unnecessarily obscure aspects of the present invention.

Referring now to the Figures, a panel system 10 is depicted, comprising a panel 12 and a retention clip 14, secured to a substrate or structure 16 by one or more fasteners 18. Panel 12 is depicted as an external wall panel having a vertical orientation, however a horizontal orientation is fully within the scope and spirit of the present invention. Further, panel 12 may comprise an interior wall panel or roof panel, oriented vertically or horizontally.

Panel 12 includes an outer face 20, a first end 22, a second end 30, a top edge 42 and a bottom edge 44. Panel 12 is preferably constructed of galvanized steel, although panel 12 may also comprise aluminum, polyvinyl chloride, or other suitable materials. Outer face 20 may be painted, patterned, or coated to give panel 12 the appearance of brick, stone, concrete, marble, stucco, or other desired building materials. The stippling treatment on outer face 20 depicted in the Figures is not to be considered limiting. In one embodiment, panel 12 features unitary construction being formed from a single piece of material. Various bends and folds are made on the single piece of material to create a finished panel 12.

Figure 10:
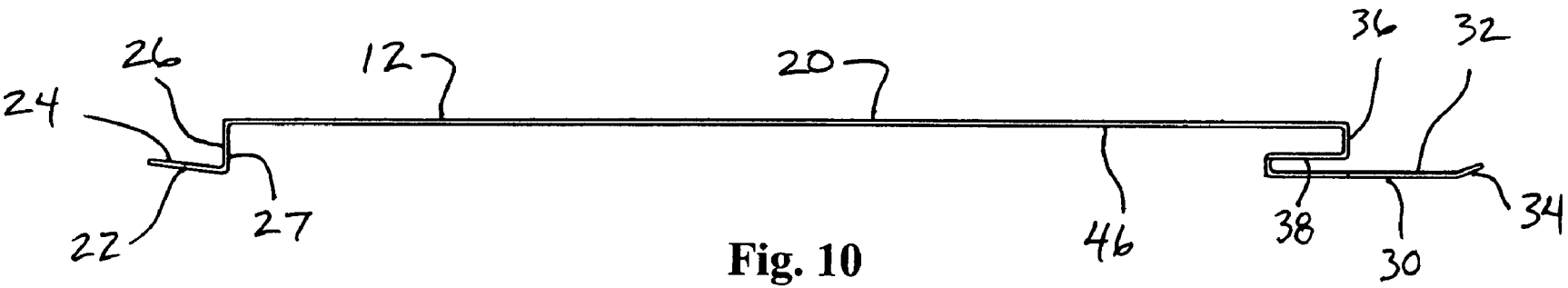
FIG. 10 is a cross-sectional view according to the line 10-10 of FIG. 4.
Figure 11:
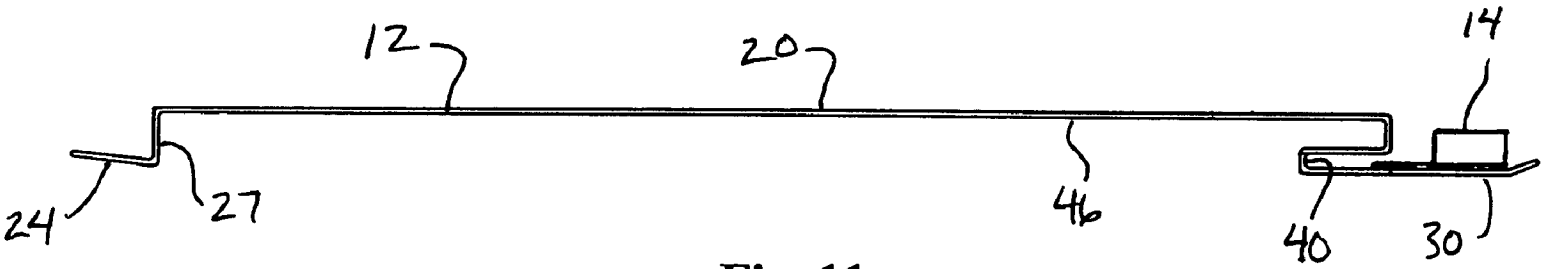
FIG. 11 is a cross-sectional view according to the line 11-11 of FIG. 9.

First end 22 comprises a male end, having a tongue 24, and a first edge 26 having an interference face 27. Tongue 24, also referred to as a protrusion or a flange, is generally parallel with outer face 20, although tongue 24 may be angled slightly toward or away from outer face 20 depending on the desired application, as depicted in FIGS. 10 and 11, to provide a friction fit for tongue 24 in a receiving groove 38. First edge 26 may be at a right angle to outer face 20, or angled slightly inward or outward, depending on the desired application.

Second end 30 comprises a female end, having a mounting flange 32 and a groove 38 adapted for receiving tongue 24. Mounting flange 32 is generally parallel to outer face 20 such that flange 32 is flush against structure 16 when installed, and flange 32 may include an upwardly disposed lip 34. An outer edge 36 is preferably at a right angle to outer face 20. Groove 38 includes an inner edge 40, and groove 38 is sized so as to receive and hold tongue 24 therein. In one embodiment, groove 38 is sized only slightly larger than the thickness of tongue 24, thereby providing a tight, secure fit for tongue 24. As depicted in the Figures, groove 38 extends the full length of second end 30, however in an alternate embodiment, groove 38 may comprise one or more non-continuous portions of the length of second end 30.

Top edge 42 and bottom edge 44 are preferably at right angles to outer face 20, and provide structural rigidity to panel 12. An inner cavity 46 underneath face 20 is defined by first edge 26 having an interference face 27, second edge 36, top edge 42 and bottom edge 44. Inner cavity 46 is optionally filled with insulation. Inner cavity may also include additional bracing (not shown) to provide further strengthening for panel 12.

Retention clip 14 generally includes a mounting base portion 50 having an aperture, hole, or bore 52, and one or more wings 54. Clip 14 is adapted to be installed on mounting flange 32, securing clip 14 and panel 12 to substrate 16 with a fastener 18. When installed on a first panel 12, clip 14 retains male end 22 of an adjoining second panel by preventing tongue 24 of said adjoining second panel from sliding out of groove 38 of first panel 12. The appearance and structure of retention clip 14 may be varied while still maintaining the retention function of clip 14.

Figure 5:
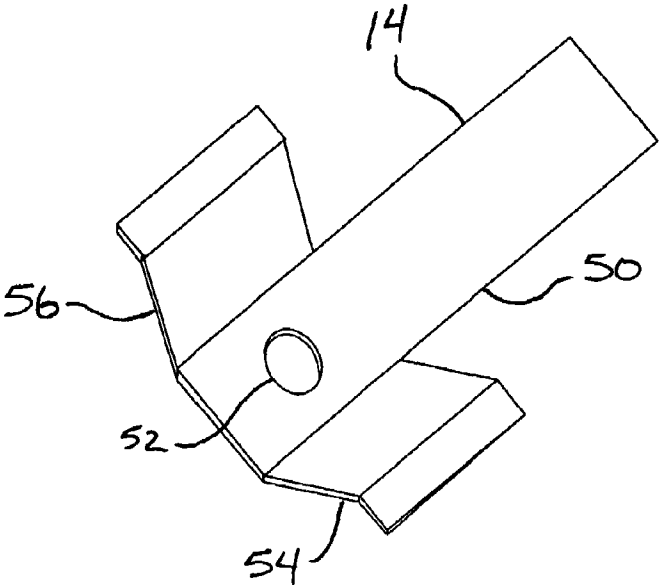
FIG. 5 is a perspective view of a retention clip according to an embodiment of the present invention.
Figure 7:
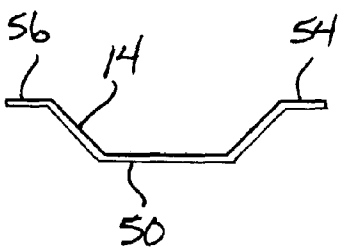
FIG. 7 is an end view of the retention clip of FIG. 5.
Figure 6:
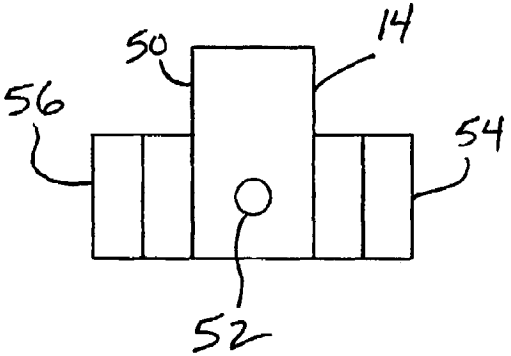
FIG. 6 is an overhead view of the retention clip of FIG. 5.
Figure 14:
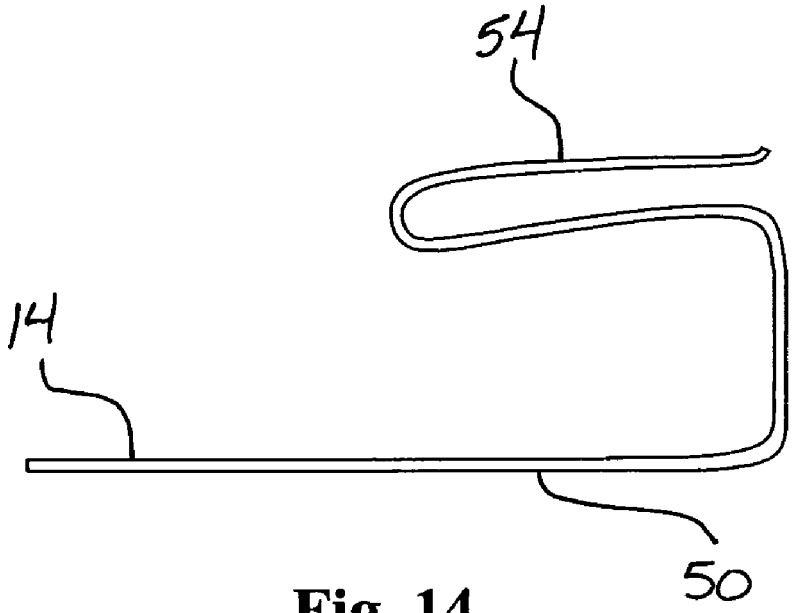
FIG. 14 is a side view of a retention clip according to another embodiment of the present invention.
Figure 15:
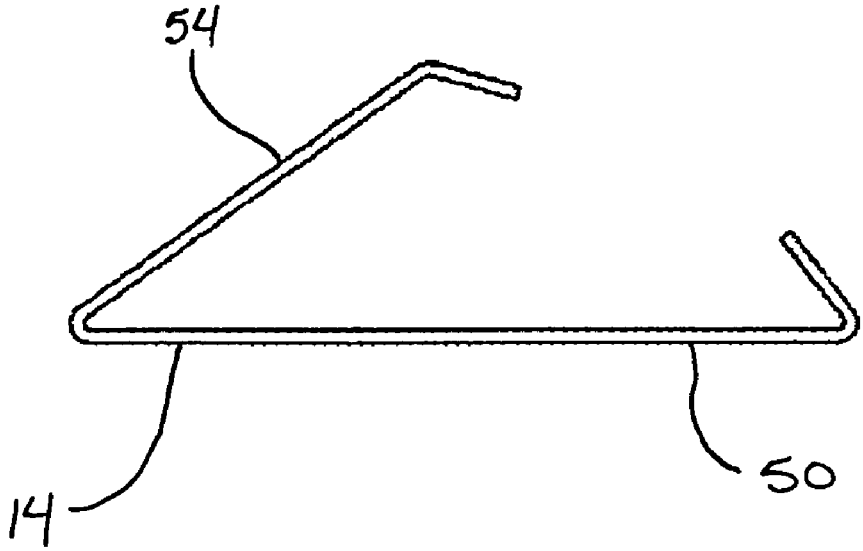
FIG. 15 is a side view of a retention clip according to another embodiment of the present invention.
Figure 16:
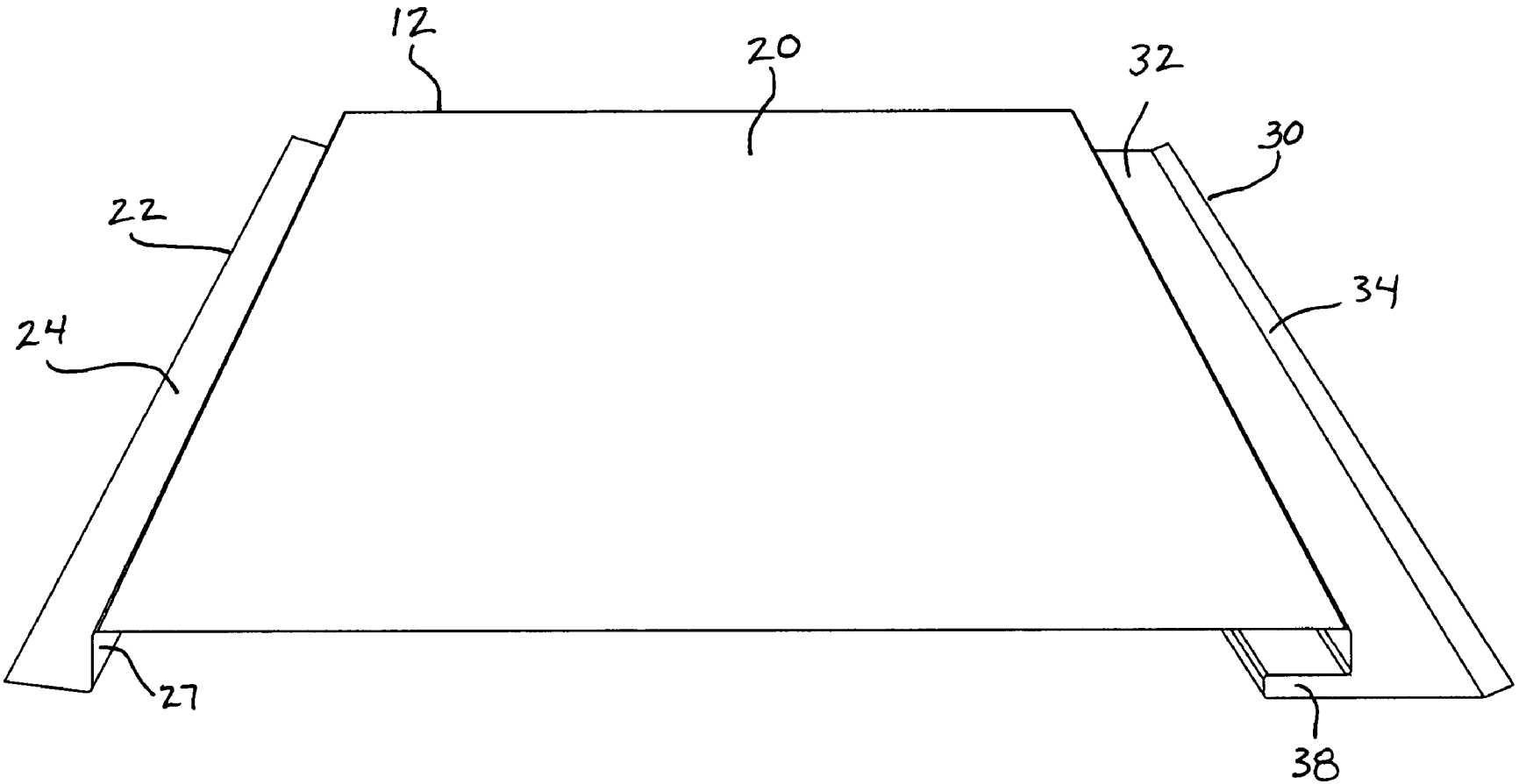
FIG. 16 is a perspective view of the panel of FIG. 10.

In one embodiment, referring to FIGS. 5-7, clip 14 comprises a first wing 54 and a second wing 56, angling upward and away from base portion 50. Wing or wings 54 of clip 14 are preferably at least half of the height of first edge 26 and interference face 27 to optimize the lateral retention of an adjoining panel. In another embodiment, clip 14 is sized so that wings 54 are slightly taller than the height of inner cavity 46, such that when a panel is installed over clip 14, wings 54 provide an outward bias to the panel in a direction normal to the substrate. Additional example embodiments are depicted in FIGS. 14-15.

Figure 12:
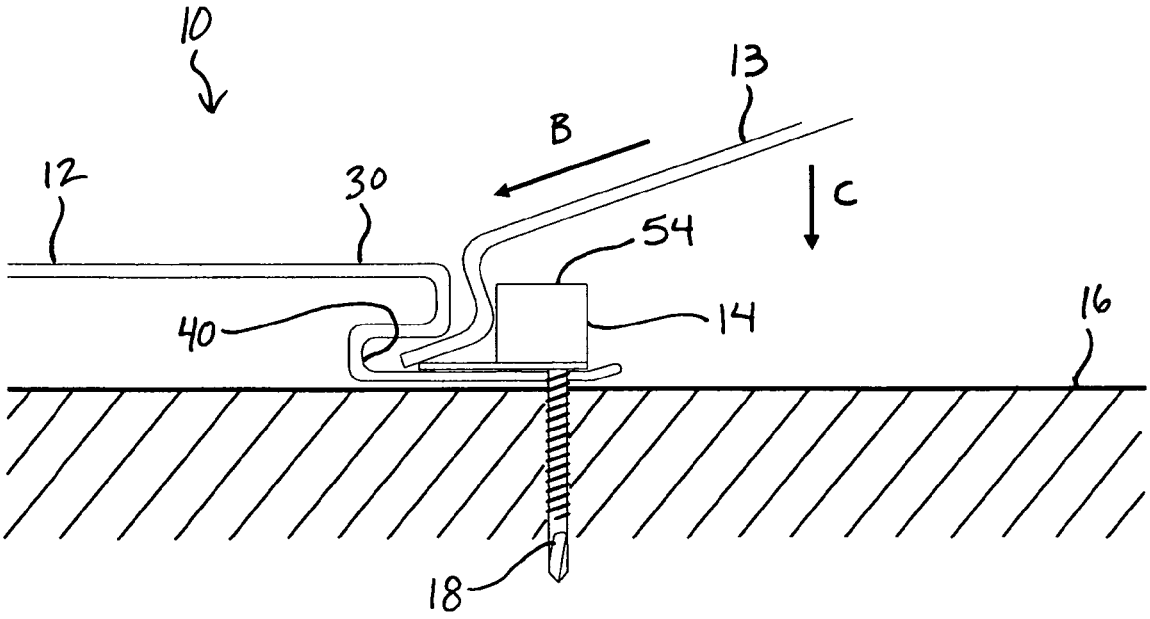
FIG. 12 is an end view of a panel system according to an embodiment of the present invention.
Figure 13:
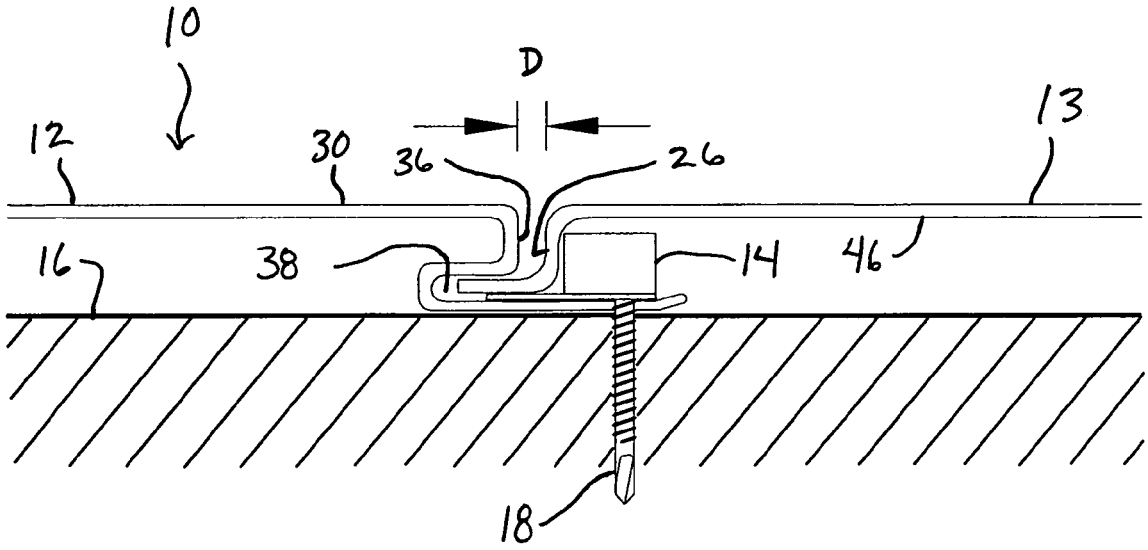
FIG. 13 is an end view of a panel system according to an embodiment of the present invention.

Referring now to FIGS. 12-13, panel system 10 is installed as follows: first end 22 of a first panel 12 is placed into the desired position, and secured to substrate 16, which may be a wall, beam, girt, hat channel, or other structural member. First end 22 is secured with fasteners 18, which may comprise self-drilling screws, concrete screws, bolts, or other suitable fasteners as will be apparent to one skilled in the art. At second end 30, one or more retaining clips are placed on mounting flange 32 with wings 54 pointing outwardly and upwardly. The spacing between clips 14 on mounting flange 32 is dependent on the desired application, but in one embodiment clips 14 are spaced about twenty-four to thirty-six inches apart. In one embodiment, clips 14 are spaced about thirty inches apart. It will be apparent that closer spacing of clips 14 provides greater retention strength of panels.

As depicted in FIG. 1A, clip 14 is positioned a distance A away from edge 36, where A is preferably in the range of ⅛ of an inch to ½ of an inch. Fasteners 18 are used to secure clip 14 and second end 30 to structure 16, and first panel 12 is installed. Depending on the desired application, first panel 12 may need to be cut to size near first end 22, thereby removing tongue 24 and first edge 26. In such an arrangement, brackets or supports may be used to support and secure first end 22 to structure 16.

To install a second or subsequent panel 13, as depicted in FIGS. 12 and 13, the tongue 24 of subsequent panel 13 is moved between clip 14 and edge 26, and into groove 38, with tongue 24 extending toward inner edge 40. Tongue 24 is inserted in the direction illustrated by arrow B in FIG. 12. The fitment of tongue 24 into groove 38 may comprise a friction-fit, the friction fit being the result of the geometries of tongue 24 and groove 38, as discussed above. The subsequent panel 13 is then positioned against structure 16, as illustrated by arrow C in FIG. 12, and second end 30 of subsequent panel 13 is secured to structure 16 according to the preceding paragraph. Adjacent panels should be separated by a distance D, the distance between edge 36 and edge 26, which is in the range of 1/32 of an inch to ¼ of an inch.

First end 22 of subsequent panel 13 is held in place in two ways. First, the interface between tongue 24 and groove 38 prevents first end 22 of subsequent panel 13 from moving outwardly, or lifting away from, first panel 12 and structure 16. Second, subsequent panel 13 is restricted from laterally moving away from first panel 12, due to the placement of subsequent panel 13 and clip 14. Interference face 27 of first end 22 of subsequent panel 13 will interfere with the wings of clip 14 if subsequent panel 13 is attempted to be pulled away from first panel 12. Upon the completion of installation of panel system 10, all fasteners 18 are hidden from view.

The panel system 10 of the present invention provides exceptional resistance to extreme weather conditions, particularly in high winds such as would be associated with a hurricane or tornado. Testing simulations were performed on panel system 10 to evaluate the structural performance of panel system 10 under simulated wind pressure. The tests were carried out in accordance with ASTM E1592, "Standard Test Method for Structural Performance of Sheet Metal Roof and Siding Systems by Uniform Static Air Pressure Difference" and ASTM E330-02, "Standard Test Method for Structural Performance of Exterior Windows, Doors, Skylights and Curtain Walls by Uniform Static Air Pressure Difference."

A summary of the construction materials is provided in Table 1, with a summary of the attachment methods provided in Table 2.

TABLE 1

Materials

| Item | Material Description |
|---|---|
| Siding | Strukturoc 16-in. × 264-in. × 0.0396-in.<br>Steel Exterior Panels<br>ASTM A653, SS GR 40, Galvanized G-90<br>Coated 2-Sided Epoxy Primer |
| Hat Channel | ASTM A653, SS GR 40, Galvanized G-90 |
| Seam Clip | ASTM A682/A684 301 Full Hard, Stainless Spring Steel<br>0.024-in. thick |

TABLE 2

Fastening Schedule

| Connection | Fastener* | Quantity or Spacing |
|---|---|---|
| Hat Channel-to-Support | ¼-in. × ⅞-in. Self-Drilling Socket Head Screws | 6 inches on-center |
| Siding Panels-to-Hat Channel | ¼-in. × ⅞-in. Self-Drilling Socket Head Screws | 2 per location |

The test setup consisted of a vacuum chamber with an open side slightly larger than the test assembly. A vacuum pump and manometer connection provide a means to apply and monitor the applied pressure. The test sample is installed to close the open side of the vacuum chamber. To seal the specimen, a 6 mil polyethylene film is used. For inward pressure (simulated positive wind), the film is placed over the completed specimen with the exterior siding facing outward with film positioned between the siding and framing. The film is pleated at each corner and at all offsets and recessed so that no fillet develops in the plastic and so that the plastic film does not influence the test results.

Instrumentation consists of a manometer and dial indicators. Dial indicators, with a resolution of 0.001-in., are positioned along selected elements to measure the maximum deflection of at least one of each type of principal member not directly and continuously supported by surrounding construction. Where the specimen is continuous over multiple supports, the gauges are positioned at the points of theoretical maximum deflection.

For testing, the loading stages are in accordance with the test standard. At each loading stage, the test load is maintained for not less than sixty seconds and deflection readings are recorded. The pressure is then reduced to zero and/or the reference pressure for a period of not more than five minutes prior to taking set deflection readings. During this period, the dial gauges are read to record the permanent deformation. This procedure is followed to obtain a minimum of six points on the load deflection curve prior to ultimate. At ultimate, the peak pressure and mode of failure are noted. Ultimate is taken as the maximum load sustained by the specimen. Any failure or observations at any point during the test are duly noted.

Three specimens were tested under inward pressure (simulated positive wind) at 36-in. on-center support spacing and three specimens were tested under outward pressure (simulated negative wind) at 36-in. on-center support spacing. A summary of the test results are provided in Tables 3 and 4.

TABLE 3

Positive Pressure, 36-in. On-Center Supports

| Specimen | Specimen Pressure (in-sure)[a] | Ultimate Pressure (psf) | Allowable Pressure[b] (psf) | Pressure at L/120 Deflection[c] (psf) | Pressure At L/90 Deflection[c] (psf) |
|---|---|---|---|---|---|
| 1 | Inward | 245.5 | 163.6 | 101.1 | 136.9 |
| 2 | | 247.5 | 165.0 | 133.9 | 192.0 |
| 3 | | 235.1 | 156.7 | 170.0 | NR |

[a]Pressure differential across specimen under normal installation conditions.
[b]Allowable pressure has been taken as the ultimate pressure divided by 1.5.
[c]Interpolated from test data.
"NR" = Deflection limit not reached.

TABLE 4

Negative Pressure, 36-in. On-Center Supports

| Specimen | Specimen Pressure (in-sure)[a] | Ultimate Pressure (psf) | Allowable Pressure[b] (psf) | Pressure at L/120 Deflection[c] (psf) | Pressure At L/90 Deflection[c] (psf) |
|---|---|---|---|---|---|
| 4 | Outward | 229.8 | 153.2 | NR | NR |
| 5 | | 197.6 | 131.7 | NR | NR |
| 6 | | 209.0 | 139.3 | NR | NR |

[a]Pressure differential across specimen under normal installation conditions.
[b]Allowable pressure has been taken as the ultimate pressure divided by 1.5.
[c]Interpolated from test data.
"NR" = Deflection limit not reached.

Simulated wind speeds well in excess of 200 miles-per-hour were withstood by panel system 10 without damage or failure. In testing, panel 12 having a size of 4.0 square feet was mounted on two support members spaced 36 inches apart on-center. A retention clip 14 according to the embodiment depicted in FIGS. 5-7 was used, having a base portion 50 of about 2.3 inches long, wings 52 and 54 about 1.0 inch wide and 0.33 inches high.

Figure 17A:
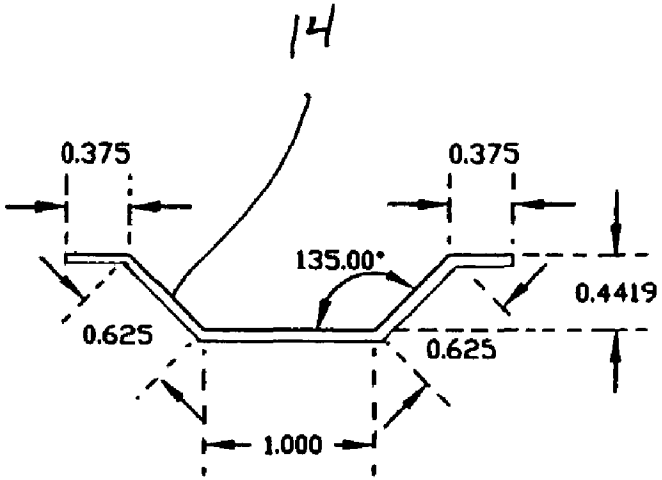
FIG. 17A is an end view of a retention clip according to an embodiment of the present invention.
Figure 17:
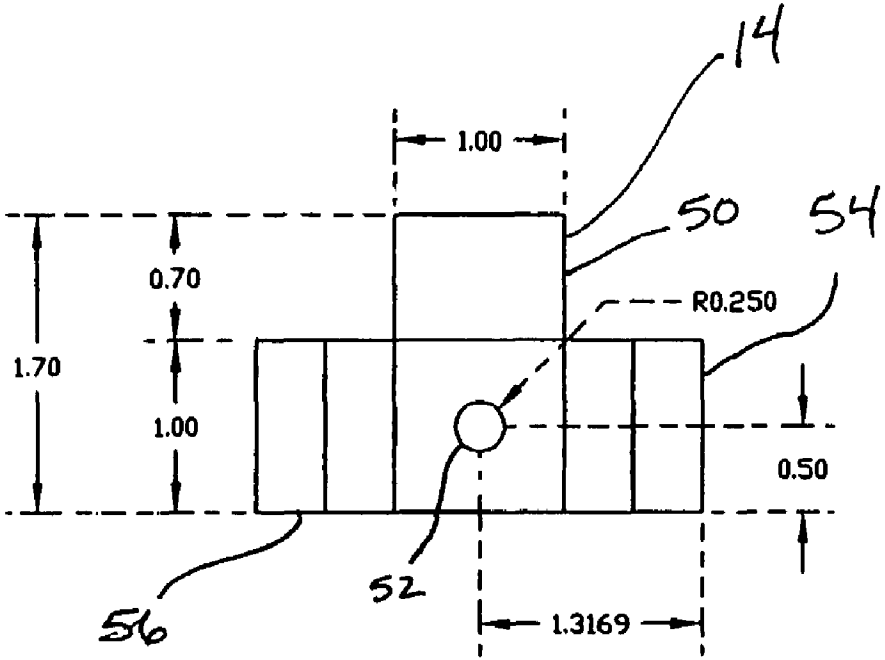
FIG. 17 is an overhead view of a retention clip according to an embodiment of the present invention.
Figure 18:
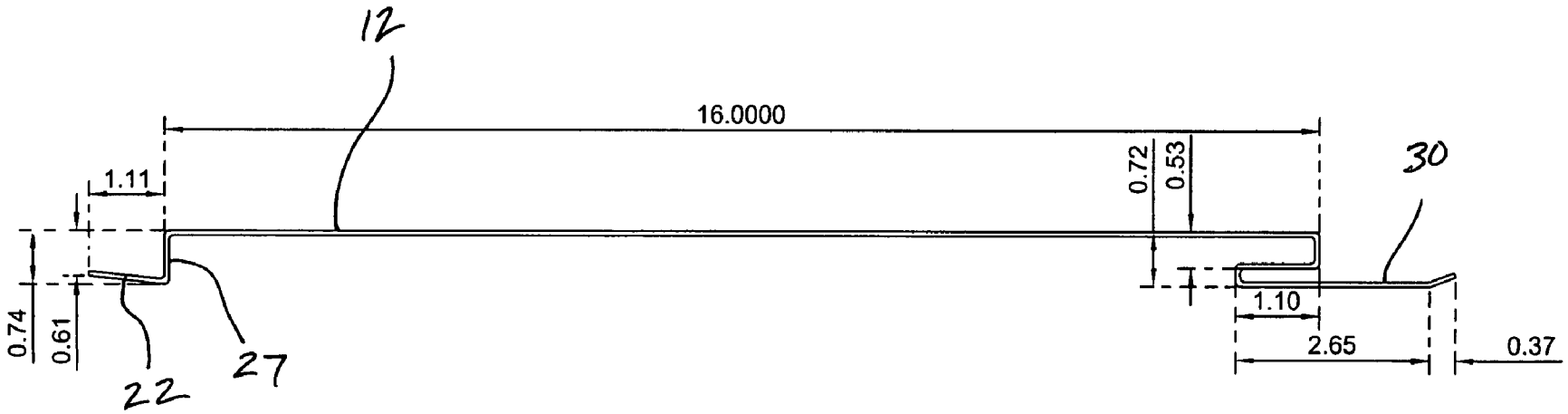
FIG. 18 is an end view of a panel according to an embodiment of the present invention.

Referring now to FIGS. 17-18, example embodiments of certain components of panel system 10 are depicted. FIGS. 17A and 17B depict a retention clip 14 according to the present invention, including measurements (in inches) of clip 14. FIG. 18 depicts a panel 12 according to the present invention, including measurements (in inches). Various dimensional relationships can be seen, for example the relationship between the height of clip 14 and the height of interference face 27, and the relationship between the sizes of tongue 24 and groove 38. The dimensions shown in FIGS. 17-18 are an example embodiment presented for illustrative purposes.

Although the present invention has been described with reference to particular embodiments, one skilled in the art will recognize that changes may be made in form and detail without departing from the spirit and scope of the invention. Therefore, the illustrated embodiments should be considered in all respects as illustrative and not restrictive.

What is claimed is:

1. A wind resistant exterior covering comprising:

a clip, including a base portion and a pair of wings protruding upward from the base portion;

a first panel including a receiving portion having a flange extending therefrom, the flange configured to be secured between the base portion of the clip and a substrate; and a second panel including a tongue portion, an outer face, an inner cavity, and an inwardly oriented substantially planar interference face defined within the inner cavity, the interference face being generally perpendicular to the outer face and including a first end depending from the outer face, and a second end, the tongue portion extending outwardly away from the second end of the interference face and adapted to be disposable in the receiving portion of the first panel, and wherein the pair of wings of the clip are adapted and located to contact the interference face of the second panel so as to restrain lateral movement of the second panel away from the first panel, wherein the wind resistant exterior covering presents a generally protrusion-free planar outer face.

2. The wind resistant exterior covering of claim 1, wherein each wing of the pair of wings diverges from the other as they extend upwardly from the base portion.

3. The wind resistant exterior covering of claim 1, wherein the first panel and the second panel are each constructed from a single piece of material.

4. The wind resistant exterior covering of claim 1, wherein the pair of wings of the clip are configured to contact the inner cavity to bias the tongue portion of the second panel against the receiving portion of the first panel.

5. The wind resistant exterior covering of claim 1, wherein the tongue portion of the second panel is configured to create a friction fit between the receiving portion and clip when the exterior covering is installed.

6. An exterior structure-covering panel, comprising:

a first end including a tongue portion;

a second end including a receiving portion and a mounting flange extending outwardly from the receiving portion and configured to be secured to a substrate;

a generally planar outer face extending between the first end and the second end; and an inner cavity underneath the outer face defined by the first end, the second end, a top edge and a bottom edge, wherein the first end is substantially planar and generally perpendicular to the outer face and extends from the outer face to the tongue portion, wherein the tongue portion extends outwardly from the first end, and wherein the receiving portion extends inwardly into the inner cavity.

7. A panel system, comprising:

a panel, including:

a generally planar outer face;

a generally planar inner face opposing the outer face;

first, second, third and fourth sidewalls extending generally in the direction of the inner face;

an inner cavity defined by an intersection of the inner face and the first, second, third and fourth sidewalls, the inner cavity including an inwardly oriented substantially planar interference face on one of the sidewalls, the interference face including a proximal portion depending from the outer face, the interference face being generally perpendicular to the outer face;

a tongue extending outwardly from a distal portion of the interference face and away from the inner cavity; and a receiving portion defined in a sidewall opposite the tongue, the receiving portion having a mounting flange extending therefrom.

8. The panel system of claim 7, further comprising a mounting clip configured to secure the receiving portion of the panel to a substrate and laterally restrain movement of a second panel away from the first panel when a tongue portion of the second panel is joined with the receiving portion of the panel.

9. The panel system of claim 8, wherein the clip includes a base portion and one or more wings protruding upward from the base portion, the one or more wings adapted and located to contact the interference face of the second panel so as to laterally restrain movement of the second panel away from the first panel.

10. The panel system of claim 9, wherein the one or more wings comprises a pair of wings protruding upward from the base portion, each wing diverging from the other as they protrude upward.

11. The panel system of claim 7, wherein the tongue does not extend upwardly beyond a plane defined by the outer face.

12. The panel system of claim 7, wherein at least part of the receiving portion extends into the inner cavity.

13. The panel system of claim 9, wherein at least part of the base portion of the clip is configured to extend into the receiving portion.

14. The panel system of claim 9, wherein the tongue is substantially planar.

15. The wind resistant exterior covering of claim 1, wherein at least part of the base portion of the clip is configured to extend into the receiving portion.

16. The wind resistant exterior covering of claim 1, wherein the tongue is substantially planar.

* * * * *